United States Patent [19]

Zimzik

[11] 4,440,654

[45] Apr. 3, 1984

[54] COOLING EMULSION AND METHOD OF PRODUCING A COOLING EMULSION

[76] Inventor: Henry Zimzik, Kirchstrasse 7, 5419 Marienhausen, Fed. Rep. of Germany

[21] Appl. No.: 364,505

[22] Filed: Apr. 1, 1982

[30] Foreign Application Priority Data

Apr. 4, 1981 [DE] Fed. Rep. of Germany ..... 3113724
Aug. 20, 1981 [DE] Fed. Rep. of Germany ..... 3132886

[51] Int. Cl.[3] ..... C10M 3/26

[52] U.S. Cl. ..... 252/34.7; 252/42; 252/49.5

[58] Field of Search ..... 252/34.7, 42, 49.5, 252/51.5 A

[56] References Cited

U.S. PATENT DOCUMENTS

| | | | |
|---|---|---|---|
| Re. 20,361 | 5/1937 | Schrader | 252/34.7 X |
| 1,948,194 | 2/1934 | Williams | 252/49.5 X |
| 2,259,466 | 10/1941 | Harris et al. | 252/51.5 A X |
| 2,346,124 | 4/1944 | Dew | 252/49.5 |
| 2,524,017 | 9/1950 | Hance et al. | 252/49.5 X |
| 3,023,163 | 2/1962 | Fucinari et al. | 252/34.7 |
| 3,354,180 | 11/1967 | Ekiss et al. | 252/49.5 X |

FOREIGN PATENT DOCUMENTS

| | | | |
|---|---|---|---|
| 473056 | 9/1937 | United Kingdom | 252/42 |
| 478056 | 12/1970 | U.S.S.R. | 252/51.5 A |

OTHER PUBLICATIONS

Wilson, A. L., "Triethanolamine Emulsions", Feb. 1930, pp. 143–146, Ind. & Eng. Chem., vol. 22, No. 2.

Bastion, E. L. H., "Metalworking Lubricants", 1951, pp. 5, 6, 13, 14 and 16–18.

*Primary Examiner*—Andrew Metz

*Attorney, Agent, or Firm*—Owen, Wickersham & Erickson

[57] ABSTRACT

Method for producing a cooling emulsion, particularly for use as an auxiliary means in boring, cutting and grinding in the metalworking industry, in which organic substances which are per se insoluble in water are rendered water-dispersible and are emulsified with water. A mixture of about 3% to 15% by weight of natural wax(es) of animal and/or 0.1% to 0.45% by weight of a commercial emulsifier, and the remainder an aqueous di/tri-ethanol mixture comprising about 50% by weight of water, 37.5% by weight of di-ethanolamine and about 12.5% by weight of tri-ethanolamine is produced. Then the mixture is brought to a boil while stirring; after dissolution of the wax component, it is cooled to a reaction temperature while stirring, and subsequently, after aminization of the wax component by the di/triethanol mixture is cooled down to application temperature. For use it is further diluted with water.

20 Claims, No Drawings

COOLING EMULSION AND METHOD OF PRODUCING A COOLING EMULSION

The invention relates to a cooling emulsion and to a method for producing a cooling emulsion, particularly for use an an auxiliary means in boring, cutting, and grinding in the metalworking industry, in which organic substances which are per se insoluble in water are rendered water-dispersible and are emulsified with water, as well as the application of the cooling emulsion produced according to the method.

Boring, cutting, and grinding emulsions are generally used for cooling saws, grinding tools, boring machines, and the like, in order to dissipate the heat occurring during machining of workpieces and thereby avoid increased wear and tear of the tools due to excessive heating thereof. Until now, so-called boring oils were used for this purpose, and they were essentially mineral oils which had been rendered water-dispersible. Water-dispersibility of mineral oil is in most cases obtained by adding caustic soda to a mixture of resin oil, olein, or the like until the final product can be smoothly emulsified with water. Instead of mineral oils, spent lye of sulfides, tar oils and waste oils are also used, which are rendered water-dispersible by substantially the same method. Disinfecting and rust-preventive components such as nitrite, chromium compounds or other substances are often admixed to this type of products.

Although the products thus produced are suitable for use as cooling emulsions, they have the disadvantage of being injurious to the skin. In the form of so-called "boring oil scab", the skin injuries can make invalids of the workers servicing the tools. A further disadvantage of this type of boring oils consist in that, because of the strict environmental laws, they must be destroyed after use in burn-off installations, or they undesirably overload the drainage ditches of waste water installations, since these boring oils are, according to the state of the art, not biodegradable.

In contrast, the object of the invention is to provide a boring oil and a method for producing a boring oil, whose use does not damage the skin, which is biodegradable to avoid waste problems, and which achieves good heat dissipation in order to secure a long life for the tools used in conjunction with the boring oil.

The problem is solved in accordance with the invention by a method in which at first a mixture of about 3% to 15% by weight of natural wax of animal and/or vegetable origin, 0.1% to 0.45% by weight of a commercial emulsifier, the remainder an aqueous di, triethanolamine mixture comprising about 50% by weight of water, 37.5% by weight of diethanolamine and about 12.5% by weight of triethanolamine mixture is produced, the mixture brought to boiling while stirring, after dissolution of the wax component, cooled to a reaction temperature while stirring, and then, after the wax component has been aminized by the di-, triethanolamine mixture, cooled down to application temperature.

Further, the invention relates to the application of the cooling emulsion produced according to the method of the invention, in an approximately 2.5% to 5% (% by weight) aqueous solution with a pH value of 8–9, as an auxiliary means in boring, cutting or grinding.

It has been established that all emulsions produced in accordance with the method of the invention are well tolerated by the skin and do not cause the feared boring oil scabs. It has even been found that in the case of workers who come into contact with this type of boring oils, the scab symptoms subside when, instead of the conventional boring oils, the boring oil in accordance with the invention was used. All tested persons exhibited a remarkable improvement of the skin damages after as little as two days of using the boring oil in accordance with the invention instead of the conventional oils. Even in the case of a severe nail bed inflammation on all fingers of both hands complete healing of the inflammation could be observed after using the emulsion according to the invention for some time.

In additon to this physiological effect, the cooling emulsion according to the invention exhibited better properties than hitherto known emulsions with regard to its effectiveness as a boring oil. The boring, cutting, and grinding emulsions have an above-average heat transfer capability, so that rapid cooling of the workplace is obtained by heat transfer to the total cooling fluid in the storage container. Further, it could be observed that, for example, the areas of cut in the case of cast iron (gray iron) were smoother when using the cutting emulsion according to the invention than could be achieved before now with conventional ones, and surprisingly, less wear and tear of the tools could be observed. This could also be due to the outstanding gliding properties of the emulsion in accordance with the invention, since even during the starting of the machine tools an improvement of the operation due to their smooth running could be established as compared with that carried out with known boring oils. Finally, the emulsion according to the invention is anticorrosive and does not cause oxidation in the treated objects.

Deviations from the composition of the concentration, particularly a reduction of the contents of the boring emulsion in accordance with the invention leads to increases wear and tear of the tools, poorer heat transfer, torn cutting surfaces as well as breach of the material of the workpiece.

If the concentration according to the invention is exceeded, the result is a disadvantageous cohesion of shavings or grinding dust, while the grinding disks lock and must be exchanged after a short working period.

A further advantage of the invention consists in that the boring, cutting, and grinding emulsions in accordance with the invention are completely biodegradable, and the hitherto necessary collection and destruction of the spent boring oils in a burn-off installation is eliminated. Instead, the spent boring emulsions can be simply discharged into the sewage installations where they are processed by the sewage installations without straining the drainage system.

Usually, organic and/or vegetable waxes, preferably from plants of the genus Copernicia with the addition of a commercial emulsifier, preferably a non-ionic one, are used in the method in accordance with the invention, using about 1 to 3 parts by weight per 10 to 15 parts by weight of wax. Further, 41 parts by weight of a di-, tri-ethanolamine mixture, as well as an anticorrosive metal-wetting disinfecting agent are used which prevent growth of viruses, salmonellas, and other problem germs. Preferably, about 1% to 2% by weight of preservative is added to the total formulation. Further, up to 1% of a lemon peel extract having skin-protective properties may be admixed to the total formulation.

Usually, an emulsion according to the invention is produced by heating the wax, the emulsifier, the di- and tri-ethanol-amines together, and after dissolution of the wax component cooling, while stirring, down to the transition point. The transition point usually lies within the range of about 84° to 93° C.

After cooling of the emulsion and reaching stability at about 50° C., the preservative and, if desired, the lemon peel extract are added.

For use as an auxiliary means in drilling, boring, or cutting, the thus obtained emulsion is diluted twenty-fold to thirtyfold.

If desired, dilution can be accomplished with water at the workplace.

Usually, a commercial mixture is used as the di-triethanolamine composition comprising 75 parts of di- and 25 parts of tri-ethanolamine in a 50% aqueous solution. The wax components of the emulsion according to the invention are to range between about 10% to 15%.

A preferred preservative is an aqueous solution of dioctyl aminoethyl glycine lactate and alkyl aminoethyl glycine hydrochloride, such as marketed by the firm Goldschmidt, of Goldschmidt street, Essen/Ruhr (Germany) under the trademark TEGO.

Further features and advantages of the invention will appear in the claims and in the following description in which the embodiments are explained.

EXAMPLE 1

Ten parts by weight of a vegetable wax derived from plants of the genus Copernicia like carnauba wax, are brought to boiling, while stirring, with 82 parts by weight of a mixture comprising 50% by weight of $H_2O$, 12.5% by weight of triethanolamine and 37.5% by weight of diethanolamine, as well as 0.1 parts by weight of coconut oil acid-diethanolamide as the emulsifier and, after dissolution of the wax at boiling temperature of the mixture, cooled with continued stirring down to the transition temperature in the region of 90° C. Two parts by weight of a commercial preservative, a mixture of dioctyl aminoethyl glycine lactate and alkyl aminoethyl glycine hydrochloride are then stirred in.

This emulsion can be used as a concentrate for producing cutting, boring or grinding emulsions.

EXAMPLE 2

Fifteen parts by weight of a wax are brought to boiling with 80 parts by weight of a mixture comprising 50% by weight of $H_2O$, 12.5% of triethanolamine and 37.5% by weight of diethanolamine and 0.1% by weight of a commercial, non-ionic emulsifier such as the coconut oil acid-diethanolamide referred to above, and, after complete aminization, cooled to a temperature of 50° C. A commercial preservative in the amount of 1% is then added to the total mixture. This emulsion can be thinned with water 35-fold for use as grinding, boring or cutting emulsion, the pH value adjusting itself between 8 and 9.

EXAMPLE 3

An emulsion is prepared as described in Example 1, 3 parts by weight of amino soap of the type comprising a di-, tri-ethanolamide of an unsaturated fatty acid such as stearic acid with 6% to 10% free amine being added to the starting mixture while stirring. The emulsion, prepared with amino acid, was also suitable in dilution for use as an auxiliary means in boring, grinding, or cutting.

EXAMPLE 4

An emulsion was prepared as described in Example 2, but 0.5%–2% by weight of sodium soap were added to the starting mixture.

EXAMPLE 5

An emulsion was prepared as described in Example 1 or 2, 0.5% to 2% by weight of potassium soap being additionally admixed to the starting mixture.

EXAMPLE 6

The emulsion of Example 1 was diluted with water 35-fold for use as cutting oil, the diluted emulsion exhibiting a pH value of 10. A circular saw with a disk of 15 mm diameter was used. When using the emulsion according to the invention, the blade had to be replaced after 2,800 separations.

A comparison test with a conventional cutting oil showed that the saw blade had to be replaced already after 1,200 separations. It was further observed that the machine ran less uniformly and quietly then when using the emulsion according to the invention as the cutting oil.

EXAMPLE 7

A 3% mixture of the emulsion of Example 2 in water with a pH value of between 8 and 9 was used as the boring emulsion in a radial boring machine.

The boring machine operates satisfactorily, in particular, no rust formation was observed on the metal parts which cam into contact with the boring emulsion. Agglutination of the machine or of parts was not observed. The emulsion according to the invention is suitable as a boring emulsion.

EXAMPLE 8

A 3% mixture of the emulsion of Example 1, diluted with water 35-fold, was used in an MSO grinding machine.

It was observed that the grinding disk remained open, no agglutination of the parts occurred and the grinding dust settled down well. No rust formation on metal parts was observed, and the operating personnel suffered no skin incompatibilities.

The emulsion according to the invention is suitable for use as a grinding emulsion.

In the case of the emulsions of Examples 1 to 5, 1% by weight of oily lemon peel extract was added, this extract having a skin-protective effect.

The properties as boring, grinding or separating emulsion were not deteriorated by this skin-protecting addition.

The features of the invention disclosed in the foregoing description as well as in the claims may be essential individually as well as in any desired combination for the realization of the invention in its various embodiments.

I claim:

1. A method for producing a cooling emulsion, particularly for use as an auxiliary means in boring, cutting, and grinding in the metalworking industry, in which organic substances which are per se immiscible with water are rendered water-dispersible and are emulsified with water, comprising:

mixing (a) about 3% to 15% by weight of natural animal or vegetable wax, (b) 0.1% to 0.45% by weight of emulsifier, and (c) the remainder, an aqueous di-, tri-ethanolamine mixture comprising about 50% by weight of water, 37.5% by weight of diethanolamine and about 12.5% by weight of triethanolamine, bringing the resulting mixture to a boil while stirring to emulsify the wax component and initiate aminization, then cooling the mixture in a first cooling step to a reaction temperature of about 84° to 93° C., while stirring, completing aminizing the wax component by the di-, triethanolamine mixture, and then cooling the aminized emulsion in a second cooling step down to metalworking temperature.

2. A method in accordance with claim 1, wherein the mixing step includes mixing 3% to 6% by weight of the natural wax.

3. A method in accordance with claim 2 wherein the mixing step includes mixing in, as the emulsifier, a nonionic emulsifier.

4. A method in accordance with claim 3 wherein the mixing step includes mixing in an amino soap comprising a stearic oil acid di-, tri-ethanolamide with 6% to 10% free amine, as the emulsifier.

5. A method in accordance with claim 4 in which the emulsifier also includes 0.1 parts by weight of coconut oil acid-diethanolamide.

6. A method in accordance with claim 1, wherein the aminizing step comprises retaining reaction temperature for a period of about 10 to 20 minutes.

7. A method in accordance with claim 1, further comprising the additional steps prior to the second cooling step, after aminization, of cooling the emulsion to a temperature of about 50° C., and then adding a disinfecting, anticorrosive, metal-wetting preservative in an amount of about 1% to 2% by weight of the total mixture.

8. A method in accordance with claim 7, wherein the adding step comprises adding as the preservative, a mixture of dioctyl aminoethyl glycine lactate and alkyl aminoethyl glycine hydrochloride.

9. A method in accordance with any of claims 7 or 8, wherein the adding step further includes adding an oily lemon peel extract in an amount of about 1% by weight of the total mixture.

10. A method in accordance with claim 1, wherein the last step further includes adjusting the pH value of the emulsion to about 10.

11. A method in accordance with claim 1, wherein the mixing step further includes mixing in 5% to 10% by weight of vegetable oil.

12. A method in accordance with claim 1, wherein the mixing step further includes mixing in 1% to 3% by weight of amino soap as additional emulsifier.

13. A method in accordance with claim 12 wherein the amino soap is di-,tri-ethanolamide of an unsaturated fatty acid.

14. A method in accordance with claim 13 wherein the fatty acid is stearic acid.

15. A method in accordance with claim 1 wherein the mixing step further includes adding in 0.5% to 2% by weight of sodium or potassium soap as additional emulsifier.

16. A cooling emulsion for use in boring, cutting, and grinding, comprising:

(A) 2.5% to 5% by weight of a reacted emulsion of

| Parts by Weight | Ingredient |
|---|---|
| 3 to 15% | natural wax |
| 0.1 to 0.45% | emulsifier |
| remainder | di-, triethanolamine mixture, |

said di-,tri-ethanol mixture consisting essentially of

| Parts by Weight | Ingredient |
|---|---|
| 50% | water |
| 37.5% | diethanolamine |
| 12.5% | triethanolamine |

(B) 97.5% to 95% by weight of water, with the pH of the emulsion being pH 8 to 9.

17. The emulsion of claim 16 wherein the reacted emulsion (A) constitutes 3% of the whole and the water (B) constitutes 97%.

18. The emulsion of claim 16 wherein the emulsion further comprises at least one of the following ingredients:

| By weight of (A) as in claim 16 | Ingredient |
|---|---|
| 1% to 2% by weight | a mixture of dioctyl aminoethyl glycine lactate and alkyl aminoethyl glycine hydrochloride |
| about 1% | oily lemon peel extract |
| 1% to 3% | amino soap |
| 0.5% to 2% | sodium or potassium soap |
| 5% to 10% | vegetable oil. |

19. The emusion of claim 16 wherein the wax is a wax derived from plants of the genus copernicia.

20. The emulsion of claim 16 wherein the emulsifier is coconut oil acid-diethanolamide.

* * * * *